US007708594B2

(12) United States Patent
Xu

(10) Patent No.: US 7,708,594 B2
(45) Date of Patent: May 4, 2010

(54) ELECTRICAL CONNECTOR WITH MAGNETIC MODULE

(75) Inventor: Yong-Chun Xu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/321,470

(22) Filed: Jan. 20, 2009

(65) Prior Publication Data

US 2009/0186526 A1 Jul. 23, 2009

(30) Foreign Application Priority Data

Jan. 17, 2008 (CN) ..... 2008 2 0030700 U

(51) Int. Cl.
*H01R 13/66* (2006.01)

(52) U.S. Cl. ..... 439/620.05; 439/676

(58) Field of Classification Search ..... 333/112, 333/184, 185; 439/620.05, 620.06, 620.11, 439/60.15, 620.16, 620.17, 620.21, 620.22, 439/607.07, 676

See application file for complete search history.

(56) References Cited

U.S. PATENT DOCUMENTS

| | | | | |
|---|---|---|---|---|
| 5,659,273 | A | 8/1997 | Harpham | |
| 6,102,741 | A * | 8/2000 | Boutros et al. | 439/620.06 |
| 6,773,302 | B2 | 8/2004 | Gutierrez et al. | |
| 6,806,790 | B2 * | 10/2004 | Ji | 333/119 |
| 6,811,442 | B1 * | 11/2004 | Lien et al. | 439/620.07 |
| 6,963,255 | B2 * | 11/2005 | Zheng et al. | 333/131 |

* cited by examiner

*Primary Examiner*—Thanh-Tam T Le
(74) *Attorney, Agent, or Firm*—Ming Chieh Chang; Wei Te Chung; Andrew C. Cheng

(57) ABSTRACT

The present invention provides an electrical connector (100) including a magnetic module (200) for noise-filtering. The magnetic module (200) includes an interior printed circuit board (21), a common mode choke and a number of transformers mounted on the interior printed circuit board (21). Each of said common mode choke and transformers has a magnetic core (20,22) and a number of magnetic wires (23) winding around the magnetic cores (20,22), wherein the magnetic core (20) of the common mode choke defines two holes (203,205) parallel extending therethrough and forms a center wall (201) therebetween. The magnetic wires (23) of the common mode choke wind around the center wall (201) and through said two holes (203,205) in a same direction.

10 Claims, 6 Drawing Sheets

ELECTRICAL CONNECTOR WITH MAGNETIC MODULE

BACKGROUND OF THE INVENTION

1. Field of the Invention

The present invention relates to an electrical connector, and more particularly, to an electrical connector having magnetic module for noise-filtering.

2. Description of the Prior Art

Magnetic elements are often used in noise-filtering in the high frequency field. An electrical connector having magnetic modules with more effective noise filtering, smaller size and lower cost is always a focus of the designers of the field.

OBJECTS OF THE INVENTION

A main object of the present invention is to provide an electrical connector having magnetic modules with more effective noise filtering smaller size and lower cost.

The present invention provides an electrical connector comprising a magnetic module. The magnetic module comprises an interior printed circuit board, a common mode choke and a plurality of transformers mounted on the interior printed circuit board, each of said common mode choke and transformers has a magnetic core and a plurality of magnetic wires winding around the magnetic cores. The magnetic core of the common mode choke defines two holes parallel extending therethrough and forms a center wall therebetween, all the magnetic wires of the common mode choke winding around the center wall and through said two holes in a same direction.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
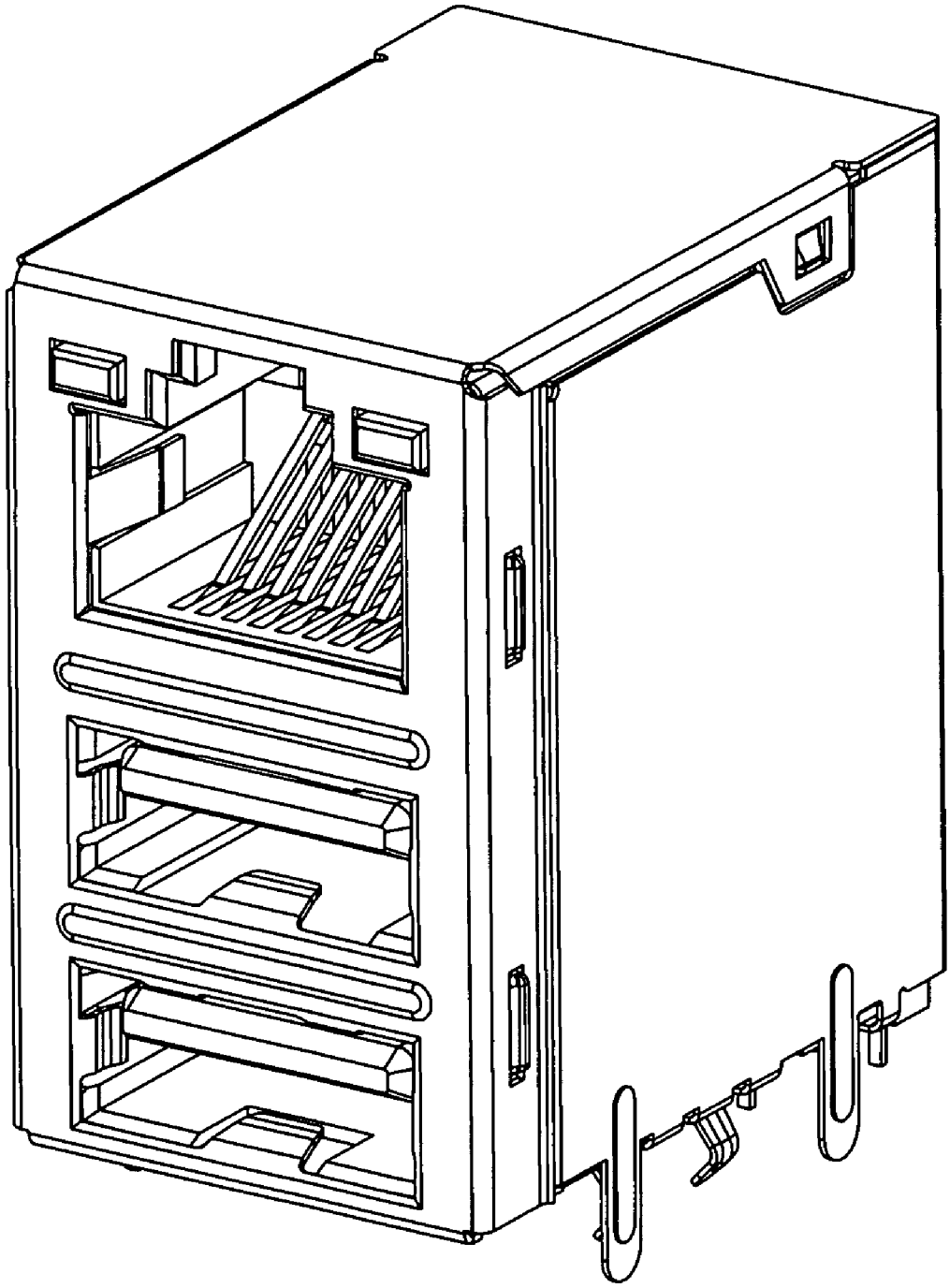
FIG. 1 is a perspective view of an electrical connector of a first embodiment according to the present invention.
Figure 2:
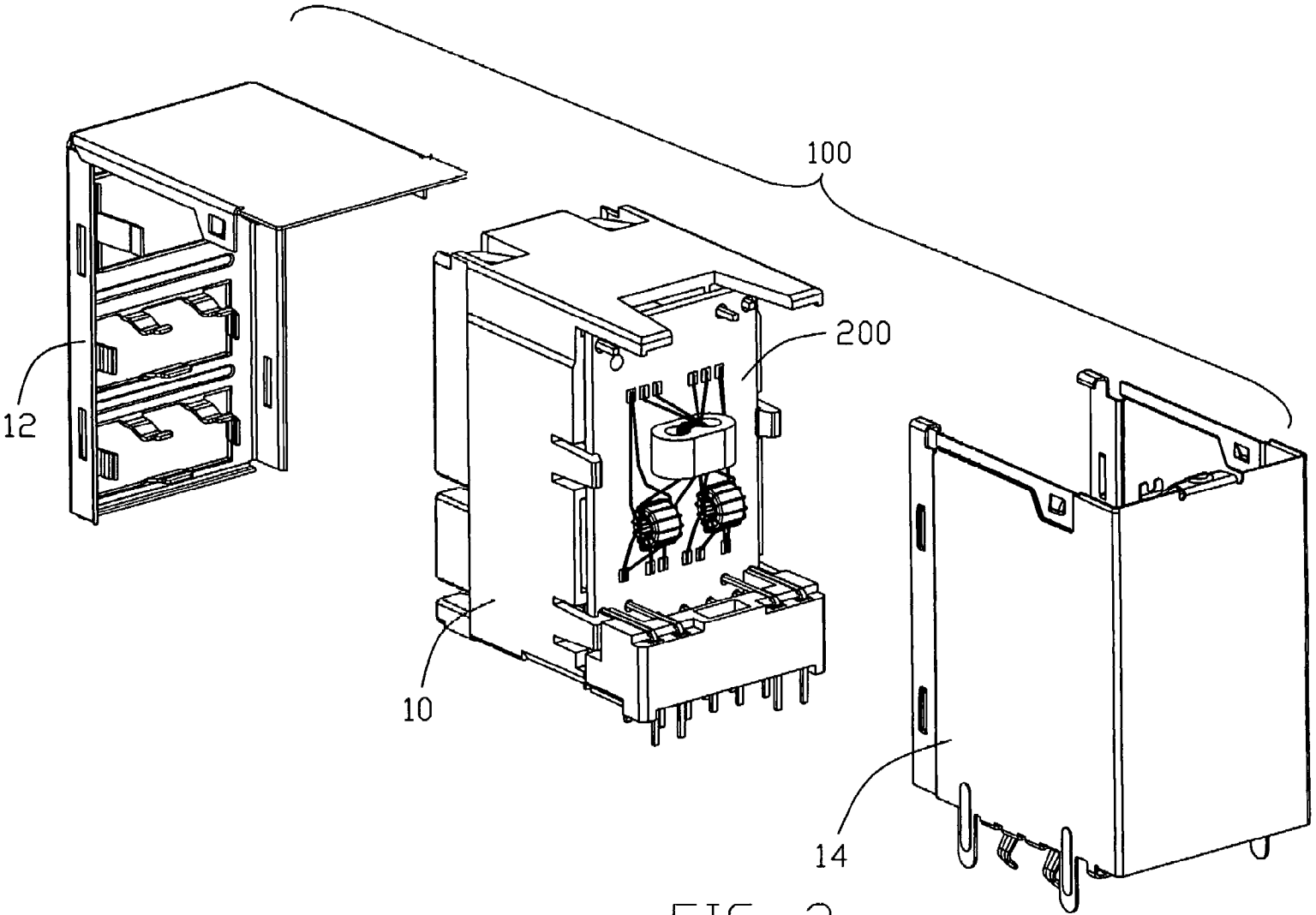
FIG. 2 is an exploded view of the electrical connector shown in FIG. 1.

Reference will now be made to the drawing figures to describe the present invention in detail.

An electrical connector 100 according to a first embodiment of the present invention is shown in FIGS. 1-4. The electrical connector 100 defines a network interface under 10/100 based standard. The electrical connector 100 includes an insulative housing 10 defining an opening (not shown) for the standard network interface, a magnetic module 200 received in the insulative housing 10 and a pair of metal shields 12,14 covering the housing 10. The electrical connector 100 can be mounted onto a printed circuit board (not shown) and a mating plug (not shown) connecting a network system can be inserted into the opening.

Figure 3:
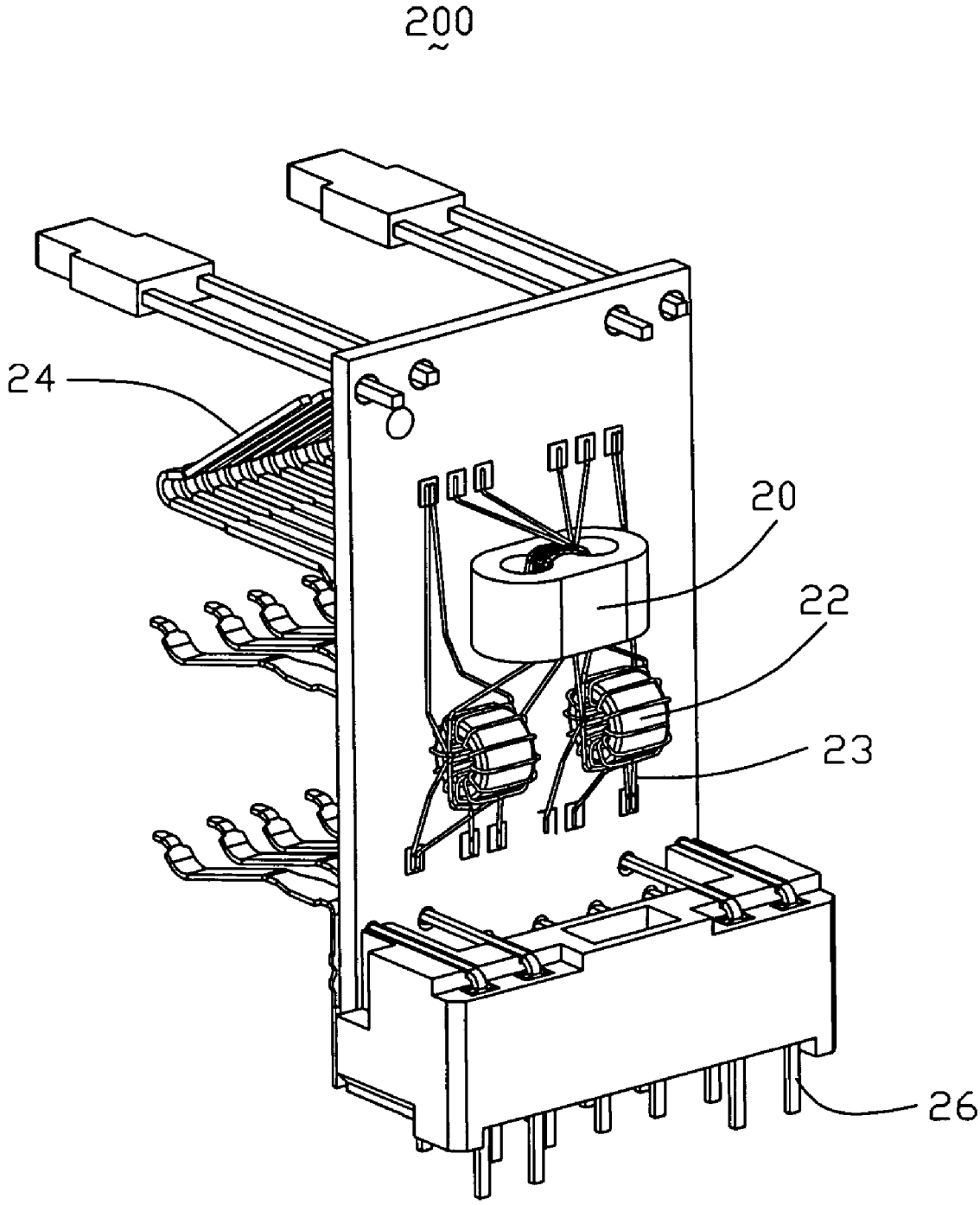
FIG. 3 is a perspective view of a magnetic module shown in FIG. 2, with the mating module and the terminal module removed.

Referring to FIG. 3, the magnetic module 200 includes an interior printed circuit board 21, a common mode choke (not labeled) and two transformers (not labeled) mounted on the interior printed circuit board 21, a mating module (not labeled) having a number of contacts 24 for connecting the mating plug and a terminal module (not labeled) having a number of terminals 26 for connecting the printed circuit board. Each of the common mode choke and the two transformers has a magnetic core 20,22 and a number of magnetic wires 23 winding around the magnetic core 20,22. The magnetic core 20 of the common mode choke defines two cylindrical holes 203,205 mutually parallel to each other and a center wall 201 formed between the two holes 203,205.

Figure 4:
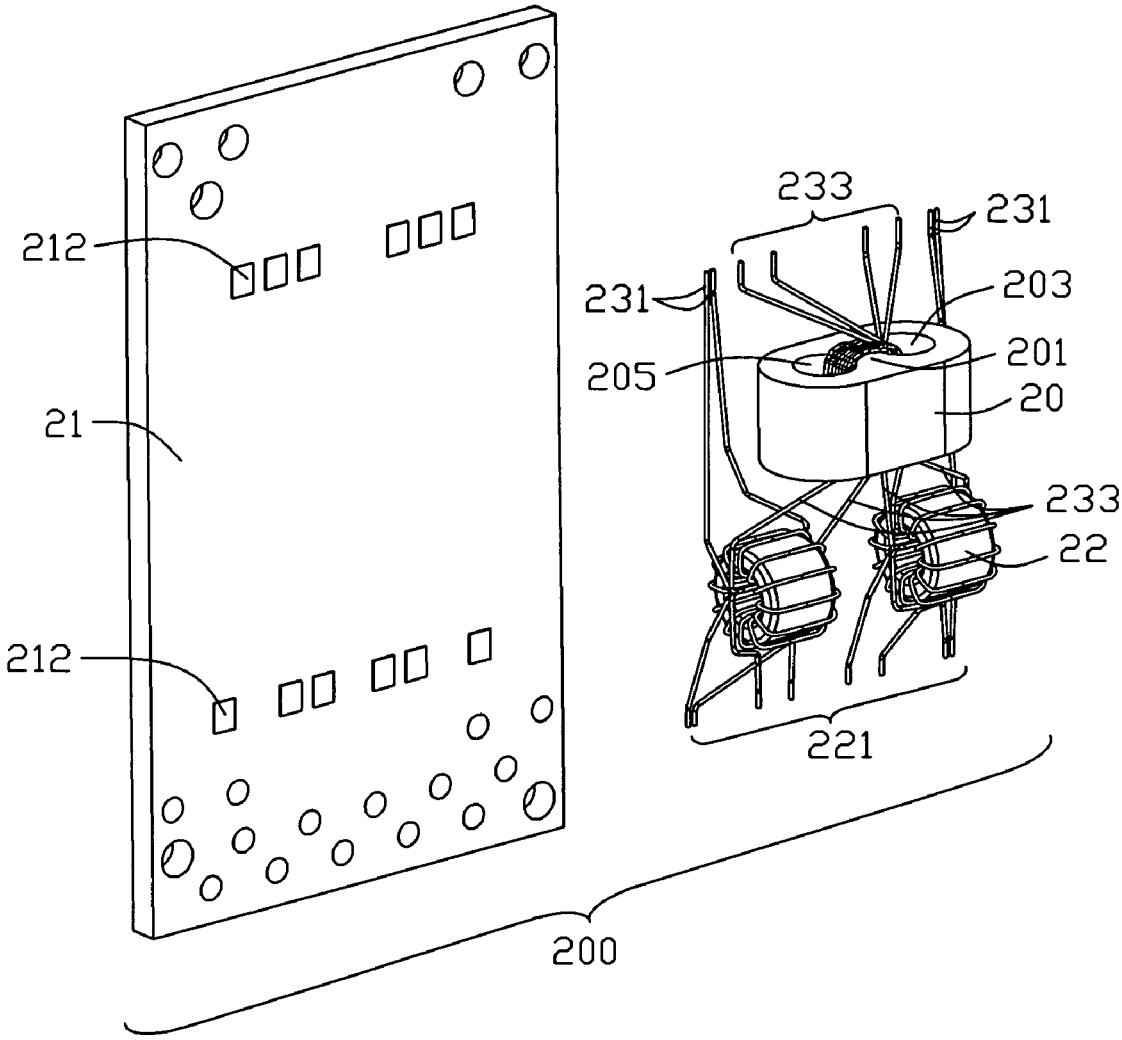
FIG. 4 is a perspective view of the magnetic module shown in FIG. 3 further with the transformers and the common mode choke apart form the interior printed circuit board.

Referring to FIGS. 3 and 4, the interior printed circuit board 21 has a number of conductive pads 212 listed in two rows parallel to each other. Each of the transformers has four magnetic wires 23, two of magnetic wires 23 being connected to ground and the others being connected to signals. The magnetic wires 23 of the transformers form four input ends 221 for carrying signals from a first row of the pads 212 and four output ends 231,233 for sending signals out into a second row of pads 212. Two of the output ends 231 being connected to ground are connected to a common one of the second row of conductive pads 212. The other output ends 233 being connected to signals are further wound around the magnetic core 20 of the common mode choke. The out put ends 233 being connected to signals of the two transformers are wound around the magnetic core 20 in a same direction through the hole 203,205 and around the center wall 201 in one time. Since the two input ends 221 are connected to a common conductive pad 212 and the output ends 231 are connected to the common conductive pad 212, material of the pad 212 can be saved. Furthermore, the output ends 233 of the magnetic wire 23 for carrying signals are wound around only one magnetic core 20 in one time, so the number of the magnetic core 20 and the time for winding the wire 23 can be saved.

Figure 5:
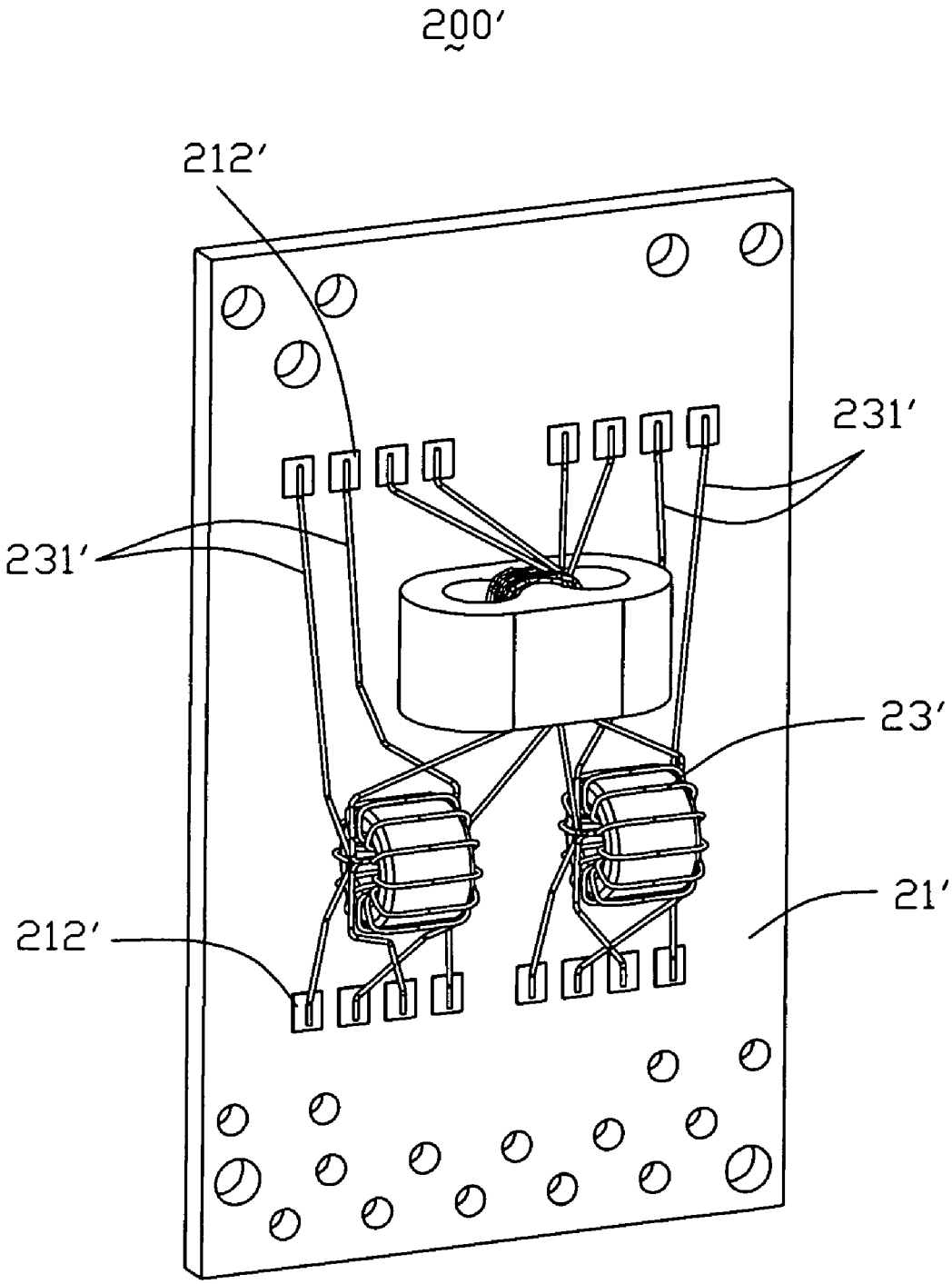
FIG. 5 is a perspective view of a magnetic module of a second embodiment according to the present invention, with the mating module and the terminal module removed.

Referring to FIG. 5, a magnetic module 200' of a second embodiment of the present invention is shown. The second embodiment is only different from the first embodiment that the two output ends 231' of each transformer are one-one soldered onto two conductive pads (not labeled) of the interior printed circuit board 21'.

Figure 6:
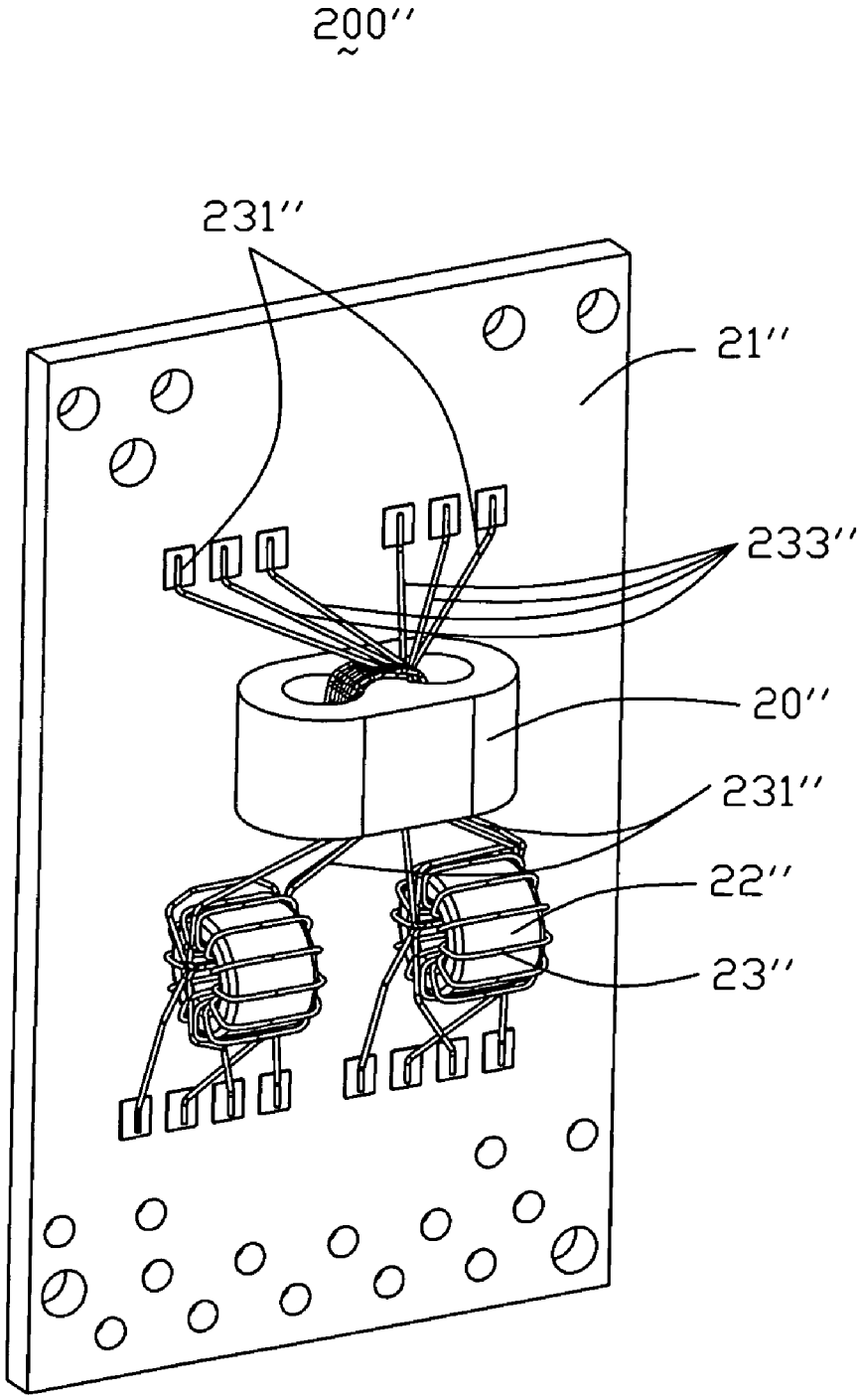
FIG. 6 is a perspective view of a magnetic module of a third embodiment according to the present invention, with the mating module and the terminal module removed.

Referring to FIG. 6, a magnetic module 200" of a third embodiment of the present invention is provided. The third embodiment is only different from the first embodiment that two output ends 231" being connected to ground of each transformer 231" are electrically connected to each other and combined to one output end 231", and then, together with the output end 233" being connected to signals, are wound around the magnetic core 20 of the common mode choke in one time. The third embodiment has an advantage that the noise in the ground is filtered as well as the noise in the signals.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

I claim:

1. An electrical connector comprising a magnetic module, said magnetic module further comprising:

an interior printed circuit board;

a common mode choke and a plurality of transformers mounted on the interior printed circuit board, each of said common mode choke and said transformers having a magnetic core and a plurality of magnetic wires winding around the magnetic cores;

the magnetic core of the common mode choke defining two holes parallel extending therethrough and forming a center wall therebetween, all the magnetic wires of the common mode choke winding around the center wall and through said two holes in a same direction;

wherein said magnetic module has two said transformers;

wherein at least two magnetic wires of each transformer form two output ends directly winding around the center wall of the magnetic core of said common mode choke;

wherein said holes of the magnetic core of the common mode choke are cylindrical; and wherein all the magnetic wires of the transformers further extend and wind around the magnetic core to form the magnetic wires of the common mode choke.

2. The electrical connector according to claim 1, wherein said interior printed circuit board has a plurality of conductive pads and at least two of the magnetic wires of each transformer are connected to ground, said at least two magnetic wires being directly one-one connected onto the pads of said interior printed circuit board.

3. The electrical connector according to claim 1, wherein said interior printed circuit board has a plurality of conductive pads and at least two of the magnetic wires of each transformer are connected to ground, said at least two magnetic wires being directly connected onto a common one of the conductive pads of said interior printed circuit board.

4. The electrical connector according to claim 1 further comprising an insulative housing, wherein the insulative housing defines a standard network interface for receiving a mating plug, said magnetic module being received in the insulative housing and connectable to the mating plug.

5. The electrical connector according to claim 4, wherein said magnetic module further comprises a mating module having a plurality of contacts for connecting said mating plug to said interior printed circuit board.

6. The electrical connector according to claim 5, wherein said electrical connector is mountable onto a printed circuit board, and wherein said magnetic module further comprises a terminal module having an insert and a plurality of terminals assembled in said insert for connecting said interior printed circuit board to said printed circuit board.

7. A magnetic module comprising:

a printed circuit board;

a common mode choke and a plurality of transformers mounted on the interior printed circuit board, each of said common mode choke and said transformers having a magnetic core and a plurality of magnetic wires winding around corresponding magnetic cores;

the magnetic core of the common mode choke defining two holes parallel extending therethrough and forming a center wall therebetween, the magnetic wires of the common mode choke winding around the center wall and through said two holes in a same direction;

wherein said magnetic module has two said transformers;

wherein at least two magnetic wires of each transformer form two output ends directly winding around the center wall of the magnetic core of said common mode choke; and wherein said holes of the magnetic core of the common mode choke are cylindrical.

8. The magnetic module according to claim 7, wherein said interior printed circuit board has a plurality of conductive pads and at least two of the magnetic wires of each transformer are connected to ground, each said at least two the magnetic wires being directly one-one connected onto the pads of said interior printed circuit board.

9. The magnetic module according to claim 7, wherein said interior printed circuit board has a plurality of conductive pads and at least two of the magnetic wires of each transformer are connected to ground, each of said at least two the magnetic wires being directly connected onto a common one of the conductive pads of said interior printed circuit board.

10. A magnetic module comprising:

a printed circuit board;

a first magnetic core mounted upon the printed circuit board and defining two first through holes extending along a first direction;

at least two second magnetic core mounted upon the printed circuit board, each of said second magnetic core defining a second through hole extending along a second direction perpendicular to the first direction;

first and second sets of magnetic wires winding about a same position of the first magnetic core in a same direction;

wherein said first and second sets of magnetic wires are located on an intermediate wall between the two first through holes;

wherein said first magnetic core is larger than each of said second magnetic core; and wherein said first and second sets of magnetic wires are further wounded about the corresponding second magnetic cores, respectively.

* * * * *